US009125264B2

(12) United States Patent
Tsujimura

(10) Patent No.: US 9,125,264 B2
(45) Date of Patent: Sep. 1, 2015

(54) LIGHTING DEVICE

(71) Applicant: Panasonic Intellectual Property Management Co., Ltd., Osaka (JP)

(72) Inventor: Mitsuhiro Tsujimura, Mie (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/405,091

(22) PCT Filed: May 23, 2013

(86) PCT No.: PCT/JP2013/003288

§ 371 (c)(1),
(2) Date: Dec. 2, 2014

(87) PCT Pub. No.: WO2013/183244

PCT Pub. Date: Dec. 12, 2013

(65) Prior Publication Data

US 2015/0173141 A1 Jun. 18, 2015

(30) Foreign Application Priority Data

Jun. 5, 2012 (JP) ..... 2012-128259

(51) Int. Cl.
*H05B 33/08* (2006.01)

(52) U.S. Cl.
CPC ..... *H05B 33/0815* (2013.01); *H05B 33/089* (2013.01); *H05B 33/0818* (2013.01); *H05B 33/0821* (2013.01); *H05B 33/0827* (2013.01)

(58) Field of Classification Search
CPC ..... H05B 33/0815; H05B 33/0821
USPC ..... 315/201, 247
See application file for complete search history.

(56) References Cited

U.S. PATENT DOCUMENTS

2011/0249069 A1 10/2011 Oyama
2011/0266964 A1* 11/2011 Schlenk et al. ..... 315/192

(Continued)

FOREIGN PATENT DOCUMENTS

EP 2 213 932 A1 8/2010
JP 08-191569 A 7/1996

(Continued)

OTHER PUBLICATIONS

International Search Report for corresponding International Application No. PCT/JP2013/003288 mailed Jul. 2, 2013.

(Continued)

*Primary Examiner* — Don Le
(74) *Attorney, Agent, or Firm* — Renner, Otto, Boisselle & Sklar, LLP

(57) ABSTRACT

A lighting device includes a rectifier circuit for rectifying an AC voltage, a power-factor correction circuit for inputting the rectified voltage from the rectifier circuit to generate a first DC voltage, a capacitor for smoothing the rectified voltage to generate a second DC voltage, a first lighting power supply, and a second lighting power supply. The first lighting power supply, of which input power supply is the first DC voltage, supplies lighting power to a first light source including one or more light emitting devices. The second lighting power supply, of which input power supply is the second DC voltage, supplies lighting power to a second light source including one or more light emitting devices. An output voltage of the second lighting power supply is lower than an output voltage of the first lighting power supply.

9 Claims, 4 Drawing Sheets

(56) References Cited

U.S. PATENT DOCUMENTS

| | | | | |
|---|---|---|---|---|
| 2015/0154917 | A1* | 6/2015 | Jung et al. | 345/102 |
| 2015/0171757 | A1* | 6/2015 | Jin et al. | 363/21.02 |

FOREIGN PATENT DOCUMENTS

| | | | |
|---|---|---|---|
| JP | 2009-230949 | A | 10/2009 |
| JP | 2010-177131 | A | 8/2010 |
| JP | 2011-165400 | A | 8/2011 |
| JP | 2011-171232 | A | 9/2011 |
| JP | 2011-210446 | A | 10/2011 |
| JP | 2011-222360 | A | 11/2011 |

OTHER PUBLICATIONS

Form PCT/ISA/237 for corresponding International Application No. PCT/JP2013/003288 dated Jul. 2, 2013.

* cited by examiner t0
t1
t10
t11
T1

LIGHTING DEVICE

TECHNICAL FIELD

The disclosure relates to a lighting device.

BACKGROUND ART

Conventionally, a lighting device configured to power light-emitting diodes (LEDs) as a light source has been known. There is also a lighting device configured to power both a main light source formed of a large number of LEDs and an auxiliary light source which is formed of a small number of LEDs and configured to be driven as indirect light for example (e.g., JP Pub. No. 2011-222360).

FIG. 4 shows a circuit diagram of a conventional lighting device configured to power two light sources. The lighting device is formed of a full-wave rectifier circuit 101, a power-factor correction circuit 102, a first lighting power supply 103 and a second lighting power supply 104. The lighting device, of which input power supply is a commercial power supply E101 (100V, 50 Hz/60 Hz), is configured to supply lighting power to a first light source 105 as a main light source and a second light source 106 as an auxiliary light source.

The full-wave rectifier circuit 101 is formed of a diode bridge and configured to full-wave rectify an AC voltage Vac from the commercial power supply E101 to generate a rectified voltage Vdb.

The power-factor correction circuit 102 is formed of a step-up chopper circuit including an inductor L101, a diode D101, a switching device Q101 and a capacitor C101. A series circuit of the inductor L101 and the switching device Q101 is connected between output ends of the full-wave rectifier circuit 101. A series circuit of the diode D101 and the capacitor C101 is connected in parallel with the switching device Q101. The switching device Q101 is repeatedly turned on and off by switching control by a switch controller (not shown). The rectified voltage Vdb is consequently stepped up and a DC voltage Vdc11 is generated between both ends of the capacitor C101. Harmonic distortion of an input current from the commercial power supply E101 is reduced through the power-factor correction circuit 102 so that reduction in power factor is suppressed.

The first lighting power supply 103 is formed of a step-down chopper circuit including an inductor L102, a diode D102, a switching device Q102 and a capacitor C102. A series circuit of the capacitor C102, the inductor L102 and the switching device Q102 is connected between both output ends of the power-factor correction circuit 102. The diode D102 is connected in parallel with a series circuit of the capacitor C102 and the inductor L102. The switching device Q102 is repeatedly turned on and off by switching control by a switch controller (not shown). The DC voltage Vdc11 is consequently stepped down and a DC voltage Vdc12 is generated between both ends of the capacitor C102.

The first light source 105 is formed of light-emitting diodes LD101 in series, and connected in parallel with the capacitor C102. The DC voltage Vdc12 is to be applied thereto. The switch controller of the first lighting power supply 103 performs switching control of the switching device Q102 to control the DC voltage Vdc12 so as to supply a specified DC current to the first light source 105, thereby supplying an electric current to the first light source 105 by constant current control. The DC voltage Vdc12 is applied to the first light source 105 and the specified DC current flows therethrough, so that each light-emitting diode LD101 is lit.

The second lighting power supply 104 is formed of a step-down chopper circuit including an inductor L103, a diode D103, a switching device Q103 and a capacitor C103. A series circuit of the capacitor C103, the inductor L103, and the switching device Q103 is connected between output ends of the power-factor correction circuit 102. The diode D103 is connected in parallel with a series circuit of the capacitor C103 and the inductor L103. The switching device Q103 is repeatedly turned on and off by switching control by a switch controller (not shown). The DC voltage Vdc11 is consequently stepped down and a DC voltage Vdc13 is generated between both ends of the capacitor C103.

The second light source 106 is formed of light-emitting diodes LD101 in series, and connected in parallel with the capacitor C103. The DC voltage Vdc13 is to be applied thereto. The switch controller of the second lighting power supply 104 performs switching control of the switching device Q103 to control the DC voltage Vdc13 so as to supply a specified DC current to the second light source 106, thereby supplying an electric current to the second light source 106 by constant current control. The DC voltage Vdc13 is applied to the second light source 106 and the specified DC current flows therethrough, so that each light-emitting diode LD101 is lit.

Since the first light source 105 is employed as the main light source, it is formed of more light-emitting diodes LD101 than those of the second light source 106. Therefore, the DC voltage Vdc12 output from the first lighting power supply 103 is larger than the DC voltage Vdc13 output from the second lighting power supply 104. In the conventional example, the DC voltage Vdc12 is set to 300V, and the DC voltage Vdc13 is set to 20V.

Since the first and second lighting power supplies 103 and 104 are formed of respective step-down chopper circuits, the DC voltage Vdc11 output from the power-factor correction circuit 102 requires to be set higher than the DC voltages Vdc12 and Vdc13. In the conventional example, the DC voltage Vdc11 output from the power-factor correction circuit 102 is set to 410V.

Thus, in the conventional example, the first and second lighting power supplies 103 and 104 are connected in parallel with each other. The first lighting power supply 103, of which input power supply is the power-factor correction circuit 102, supplies lighting power to the first light source 105. The second lighting power supply 104, of which input power supply is the power-factor correction circuit 102, supplies lighting power to the second light source 106.

In the conventional example, the second lighting power supply 104 outputs the DC voltage Vdc13 of 20V, but it is low nevertheless, employs the DC voltage Vdc11 (=410V) output from the power-factor correction circuit 102 as an input power supply thereof. Therefore, the second lighting power supply 104 requires to be formed of components having a rated voltage (a withstand voltage) of 410V or more, which causes increase in size and cost of components constituting the second lighting power supply 104, and results in a problem of increase in size and costs of the lighting device per se.

SUMMARY OF INVENTION

The present invention has been achieved in view of the above circumstances, and an object thereof is to provide a lighting device capable of achieving miniaturization and cost reduction thereof.

In an aspect of the present invention, a lighting device includes a rectifier circuit, a power-factor correction circuit, a capacitor, one or more first lighting power supplies and one or more second lighting power supplies. The rectifier circuit is configured to rectify an AC voltage. The power-factor correction circuit is configured to receive the rectified voltage from the rectifier circuit to generate a first DC voltage. The capacitor is configured to reduce ripple of the rectified voltage to generate a second DC voltage. The one or more first lighting power supplies, of each of which input power supply is the first DC voltage, are configured to supply lighting power to respective one or more first light sources each of which comprises one or more light emitting devices. The one or more second lighting power supplies, of each of which input power supply is the second DC voltage, are configured to supply lighting power to respective one or more second light sources each of which comprises one or more light emitting devices. An output voltage of the one or more second lighting power supplies is lower than an output voltage of the one or more first lighting power supplies.

In the lighting device, it is preferable that each of the one or more first lighting power supplies comprise a step-down chopper circuit.

In the lighting device, it is preferable that each of the one or more second lighting power supplies comprise a step-down chopper circuit.

In the lighting device, it is preferable that the one or more first lighting power supplies be two or more first lighting power supplies, the one or more second lighting power supplies be two or more second lighting power supplies, total output power of the two or more first lighting power supplies be larger than 25 W, and total output power of the two or more second lighting power supplies be 15 W or less.

In the lighting device, it is preferable that the second DC voltage be lower than the first DC voltage.

In the lighting device, it is preferable that the power-factor correction circuit be configured to step up the rectified voltage to generate the first DC voltage so that the first DC voltage is higher than the second DC voltage.

In the lighting device, it is preferable that the one or more first lighting power supplies be configured to step down the first DC voltage to generate respective output voltages of the one or more first lighting power supplies.

In the lighting device, it is preferable that the one or more second lighting power supplies be configured to step down the second DC voltage to generate respective output voltages of the one or more second lighting power supplies.

In the lighting device, it is preferable that the capacitor be connected in parallel with the power-factor correction circuit.

As stated above, the invention can reduce each withstand voltage of components constituting a second lighting power supply and achieve the miniaturization and cost reduction.

BRIEF DESCRIPTION OF DRAWINGS

Preferred embodiments of the invention will now be described in further details. Other features and advantages of the present invention will become better understood with regard to the following detailed description and accompanying drawings where.

DESCRIPTION OF EMBODIMENTS

Embodiments of the present invention are hereinafter explained with reference to drawings.

(Embodiment 1)

Figure 1:
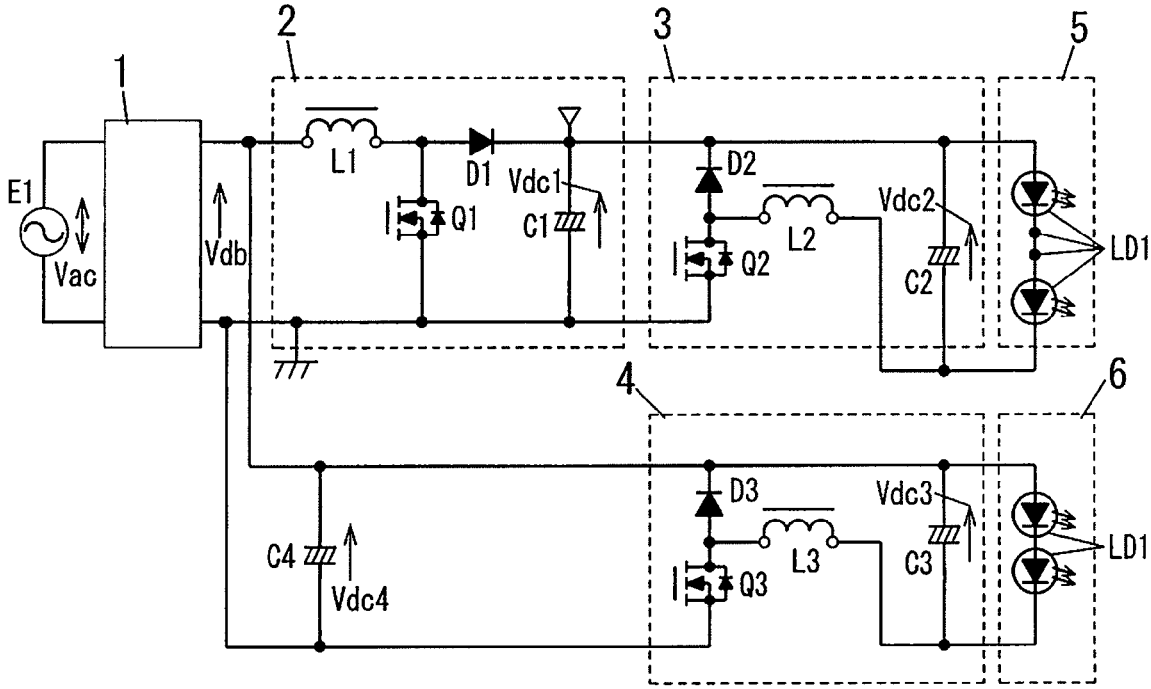
FIG. 1 is a circuit diagram of a lighting device in accordance with embodiment 1 of the invention.

FIG. 1 shows a circuit diagram of a lighting device in the embodiment. The lighting device in the embodiment is formed of a full-wave rectifier circuit 1, a power-factor correction circuit 2, a first lighting power supply 3, a second lighting power supply 4, and a capacitor C4. The lighting device in the embodiment, of which input power supply is a commercial power supply E1 (100V, 50/60 Hz), is configured to supply lighting power to a first light source 5 as a main light source including a large number of light-emitting diodes LD1 and a second light source 6 as an auxiliary light source that includes a small number of light-emitting diodes LD1 and is configured to emit indirect light.

The full-wave rectifier circuit 1 (a rectifier circuit) is formed of a diode bridge and configured to full-wave rectify an AC voltage Vac from the commercial power supply E1 to generate a rectified voltage Vdb.

The power-factor correction circuit 2 is formed of a step-up chopper circuit including an inductor L1, a diode D1, a switching device Q1 and a capacitor C1. A series circuit of the inductor L1 and the switching device Q1 is connected between output ends of the full-wave rectifier circuit 1. A series circuit of the diode D1 and the capacitor C1 is connected in parallel with the switching device Q1. The switching device Q1 is repeatedly turned on and off by switching control by a switch controller (not shown). The rectified voltage Vdb is consequently stepped up and a DC voltage Vdc1 (a first DC voltage) is generated between both ends of the capacitor C1. Harmonic distortion of an input current from the commercial power supply E1 is reduced through the power-factor correction circuit 102 so that reduction in power factor is suppressed.

The first lighting power supply 3 is formed of a step-down chopper circuit including an inductor L2, a diode D2, a switching device Q2 and a capacitor C2. A series circuit of the capacitor C2, the inductor L2 and the switching device Q2 is connected between both output ends of the power-factor correction circuit 2. The diode D2 is connected in parallel with a series circuit of the capacitor C2 and the inductor L2. The switching device Q2 is repeatedly turned on and off by switching control by a switch controller (not shown). The DC voltage Vdc1 is consequently stepped down and a DC voltage Vdc2 (an output voltage of the first lighting power supply 3, namely a first output voltage) is generated between both ends of the capacitor C2.

The first light source 5 is formed of light-emitting diodes LD1 (light-emitting devices) in series, and connected in parallel with the capacitor C2. The DC voltage Vdc2 is to be applied thereto. The switch controller of the first lighting power supply 3 performs switching control of the switching device Q2 to control the DC voltage Vdc2 so as to supply a specified DC current to the first light source 5, thereby supplying an electric current to the first light source 5 by constant current control. The DC voltage Vdc2 is applied to the first light source 5 and the specified DC current flows therethrough, so that each light-emitting diode LD1 is lit. The first light source 5 in the embodiment is formed of two or more light-emitting diodes LD1, but may be formed of a single light-emitting diode.

The capacitor C4 is connected between the output ends of the full-wave rectifier circuit 1 (i.e., connected in parallel with the power-factor correction circuit 2) and is configured to reduce ripple of the rectified voltage Vdb to generate a DC voltage Vdc4 (a second DC voltage). That is, the full-wave rectifier circuit 1 and the capacitor C4 constitute a capacitor input type rectifier/filter circuit.

The second lighting power supply 4 is formed of a step-down chopper circuit including an inductor L3, a diode D3, a switching device Q3 and a capacitor C3. A series circuit of the capacitor C3, the inductor L3 and the switching device Q3 is connected in parallel with the capacitor C4.

The diode D3 is connected in parallel with a series circuit of the capacitor C3 and the inductor L3. The switching device Q3 is repeatedly turned on and off by switching control by a switch controller (not shown). The DC voltage Vdc4 is consequently stepped down and a DC voltage Vdc3 (an output voltage of the second lighting power supply 4, namely a second output voltage) is generated between both ends of the capacitor C3.

The second light source 6 is formed of light-emitting diodes LD1 (light-emitting devices) in series, and connected in parallel with the capacitor C3. The DC voltage Vdc3 is to be applied thereto. The switch controller of the second lighting power supply 4 performs switching control of the switching device Q3 to control the DC voltage Vdc3 so as to supply a specified DC current to the second light source 6, thereby supplying an electric current to the second light source 6 by constant current control. The DC voltage Vdc3 is applied to the second light source 6 and the specified DC current flows therethrough, so that each light-emitting diode LD1 is lit. The second light source 6 of the embodiment is formed of two or more light-emitting diodes LD1, but may be formed of a single light-emitting diode.

The first light source 5 is employed as the main light source, and accordingly formed of more light-emitting diodes LD1 than those of the second light source 6. Therefore, the DC voltage Vdc2 output from the first lighting power supply 3 is larger than the DC voltage Vdc3 output from the second lighting power supply 4. In the embodiment, the DC voltage Vdc2 is set to 300V, and the DC voltage Vdc3 is set to 20V.

Since the first lighting power supply 3 is formed of the step-down chopper circuit, the DC voltage Vdc1 output from the power-factor correction circuit 2 requires to be set higher than the DC voltage Vdc2 (=300V). Accordingly, in the embodiment, the DC voltage Vdc1 output from the power-factor correction circuit 2 is set to 410V in consideration of dispersion among forward voltages of the light-emitting diodes LD1 in the first light source 5. The DC voltage Vdc3 (=20V) output from the second lighting power supply 4 is sufficiently lower than the DC voltage Vdc4 (=about 141V) obtained by reducing ripple of the rectified voltage Vdb. The second lighting power supply 4 can step down the DC voltage Vdc4 to generate the DC voltage Vdc3.

Thus, in the lighting device of the embodiment, the first lighting power supply 3, of which input power supply is the DC voltage Vdc1 output from the power-factor correction circuit 2, is to supply lighting power to the first light source 5. The second lighting power supply 4, of which input power supply is the DC voltage Vdc4 output from the capacitor C4, is to supply lighting power to the second light source 6.

The first lighting power supply 3 sets the DC voltage Vdc1 to the input power supply thereof, and accordingly requires to be formed of components having rated voltages (withstand voltages) of 410V or more. However, the second lighting power supply 4 sets the DC voltage Vdc4 lower than the DC voltage Vdc1 to the input poser supply thereof, and can be accordingly formed of components having low rated voltages (withstand voltages) of, for example, 250V in comparison with a case where the DC voltage Vdc1 is employed as the input power supply.

That is, by using the capacitor C4 having a low output voltage for an input power supply of the second lighting power supply 4 having a lower output power, it is possible to achieve miniaturization and cost reduction of the lighting device per se and components constituting the second lighting power supply 4.

(Embodiment 2)

Figure 2:
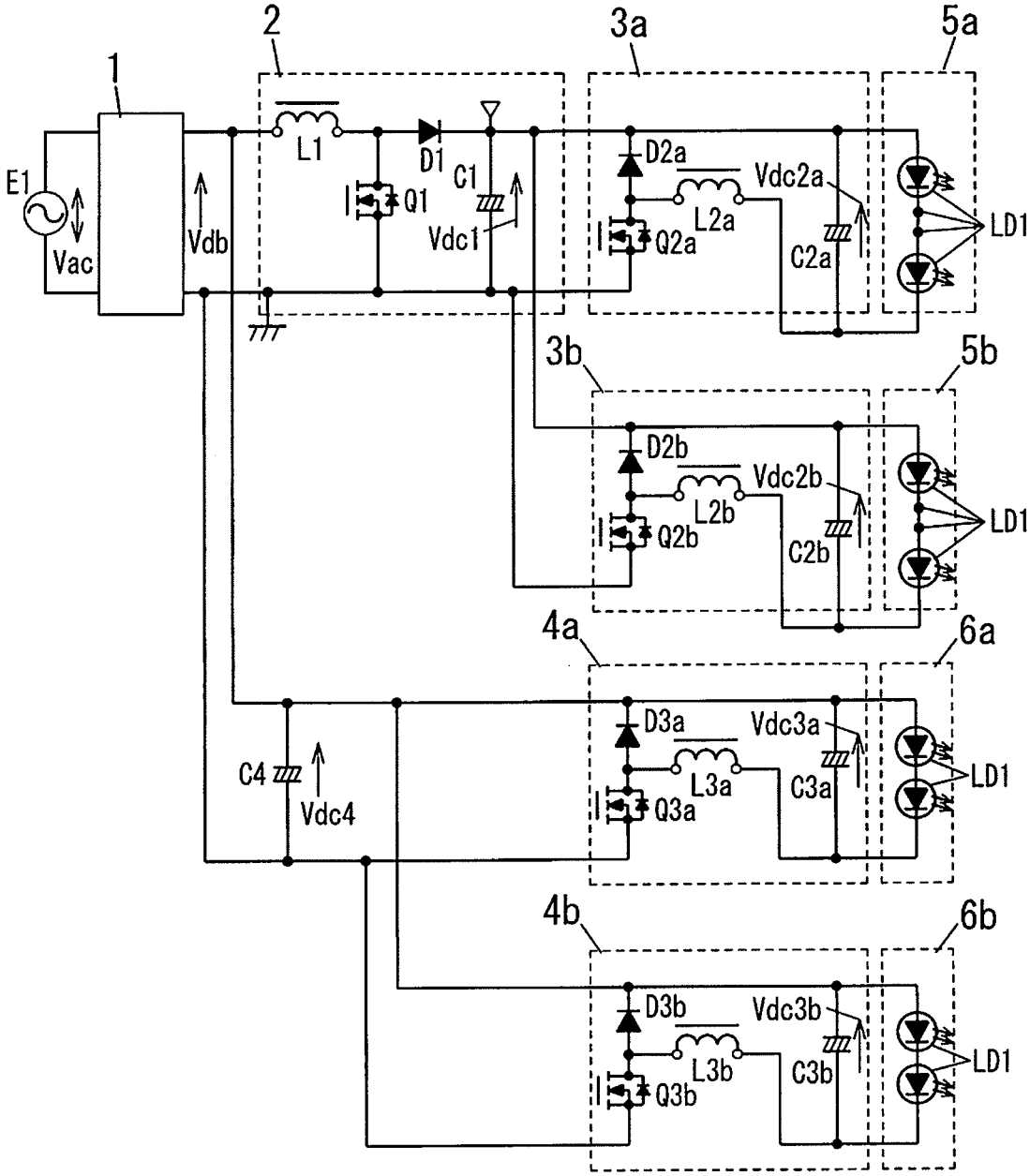
FIG. 2 is a circuit diagram of a lighting device in accordance with embodiment 2 of the invention.

FIG. 2 shows a circuit diagram of a lighting device in the embodiment. Like kind elements are assigned the same reference numerals as depicted in embodiment 1 and the explanation thereof is omitted.

The lighting device in the embodiment includes two first lighting power supplies 3*a* and 3*b* and two second lighting power supplies 4*a* and 4*b*, and is configured to supply lighting power to first light sources 5*a* and 5*b* and second light sources 6*a* and 6*b*. Each of the first lighting power supplies 3*a* and 3*b* has an identical configuration of the first lighting power supply 3 in embodiment 1, and the explanation of the first lighting power supplies 3*a* and 3*b* is omitted by adding "a" or "b" to tails of the reference numeral. In addition, each of the second lighting power supplies 4*a* and 4*b* has an identical configuration of the second lighting power supply 4 in embodiment 1, and the explanation of the second lighting power supplies 4*a* and 4*b* is omitted by adding "a" or "b" to tails of the reference numeral.

The first lighting power supply 3*a*, of which input power supply is a DC voltage Vdc1 (=410V) output from a power-factor correction circuit 2, generates a DC voltage Vdc2*a* (an output voltage of the first lighting power supply 3*a*, namely a first output voltage) and applies the DC voltage Vdc2*a* to the first light source 5*a*, thereby lighting the first light source 5*a*. In the embodiment, the DC voltage Vdc2*a* output from the first lighting power supply 3*a* is set to 250V, a DC current supplied to the first light source 5*a* is set to 350 mA, and accordingly output power of the first lighting power supply 3*a* is about 88 W.

The first lighting power supply 3*b*, of which input power supply is the DC voltage Vdc1 (=410V) output from the power-factor correction circuit 2, generates a DC voltage Vdc2*b* (an output voltage of the first lighting power supply 3*b*, namely a first output voltage) and applies the DC voltage Vdc2*b* to the first light source 5*b*, thereby lighting the first light source 5*b*. In the embodiment, the DC voltage Vdc2*b* output from the first lighting power supply 3*b* is set to 250V, a DC current supplied to the first light source 5*b* is set to 350 mA, and accordingly output power of the first lighting power supply 3*b* is about 88 W.

The second lighting power supply 4*a*, of which input power supply is a DC voltage Vdc4 (=141V) output from a capacitor C4, generates a DC voltage Vdc3*a* (an output voltage of the second lighting power supply 4*a*, namely a second output voltage) and applies the DC voltage Vdc3*a* to the second light source 6*a*, thereby lighting the second light source 6*a*. In the embodiment, the DC voltage Vdc3*a* output from the second lighting power supply 4*a* is set to 26V, a DC current supplied to the second light source 6*a* is set to 350 mA, and accordingly output power of the second lighting power supply 4*a* is about 9 W.

The second lighting power supply 4*b*, of which input power supply is a DC voltage Vdc4 (=141V) output from the capacitor C4, generates a DC voltage Vdc3*b* (an output voltage of the second lighting power supply 4*b*, namely a second output voltage) and applies the DC voltage Vdc3*b* to the second light source 6*b*, thereby lighting the second light source 6*b*. In the embodiment, the DC voltage Vdc3*b* output from the second lighting power supply 4*b* is set to 17V, a DC current supplied to the second light source 6*b* is set to 350 mA, and accordingly output power of the second lighting power supply 4*b* is about 6 W.

Like the second lighting power supply 4 in embodiment 1, the second lighting power supplies 4*a* and 4*b* employ, as their input power supply, not the DC voltage Vdc1 output from the power-factor correction circuit 2 but the DC voltage Vdc4 output from the capacitor C4. The second lighting power supplies 4*a* and 4*b* can be accordingly formed of components having low rated voltages (withstand voltages). It is consequently possible to achieve miniaturization and cost reduction of components and the lighting device per se.

In the lighting device of the embodiment, total output power (88 W+88 W=176 W) of the first lighting power supplies 3*a* and 3*b* exceeds 25 W. Harmonic distortion of an input current from a commercial power supply E1 requires satisfying Class C Standard established by IEC (International Electrotechnical Commission) (see IEC61000-3-2).

Figures 3A, 3B, 3C:
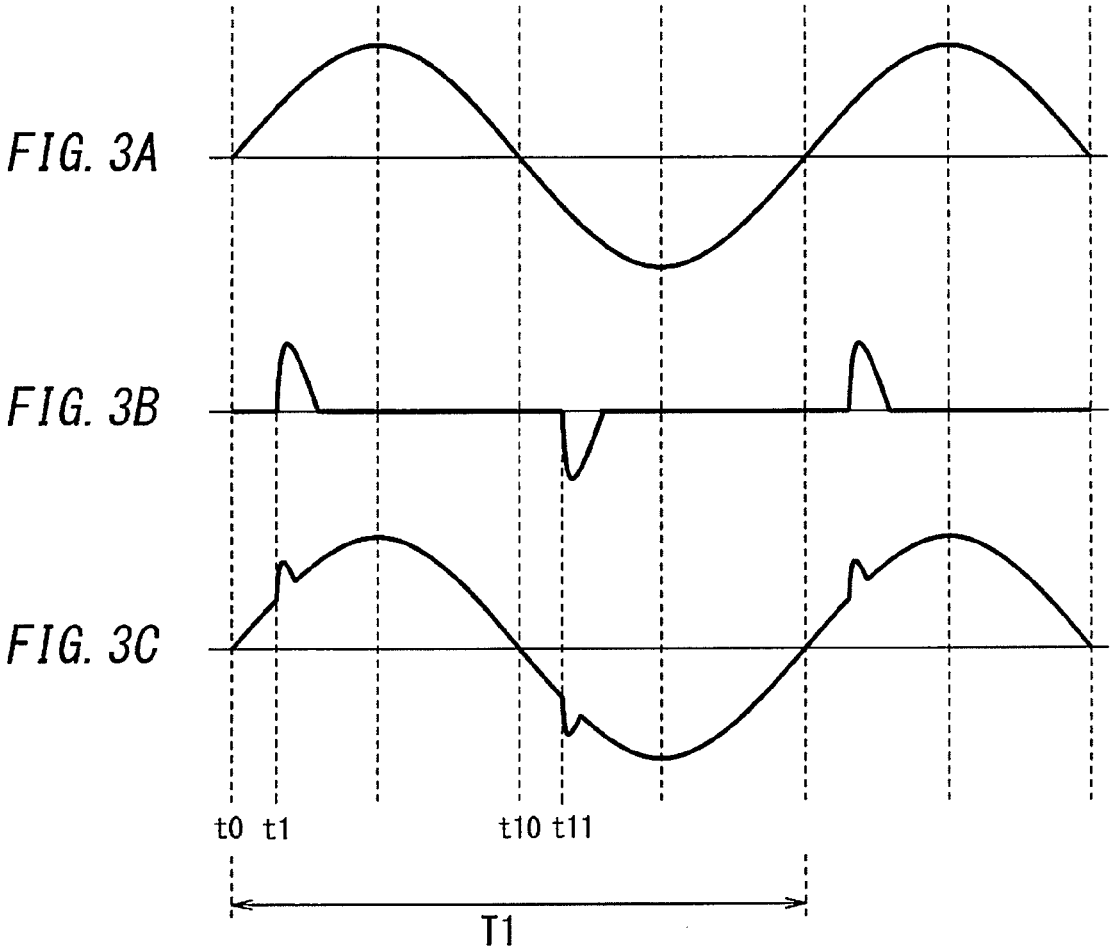
FIG. 3A is waveform of an input current of the lighting device in embodiment 2 of the invention in a case where two first light sources are lit and two second light sources are unlit.
FIG. 3B is waveform of an input current of the lighting device in embodiment 2 of the invention in a case where two second light sources are lit and two first light sources are unlit.
FIG. 3C is waveform of an input current of the lighting device in embodiment 2 of the invention in a case where two first light sources and two second light sources are lit.
Figure 4:
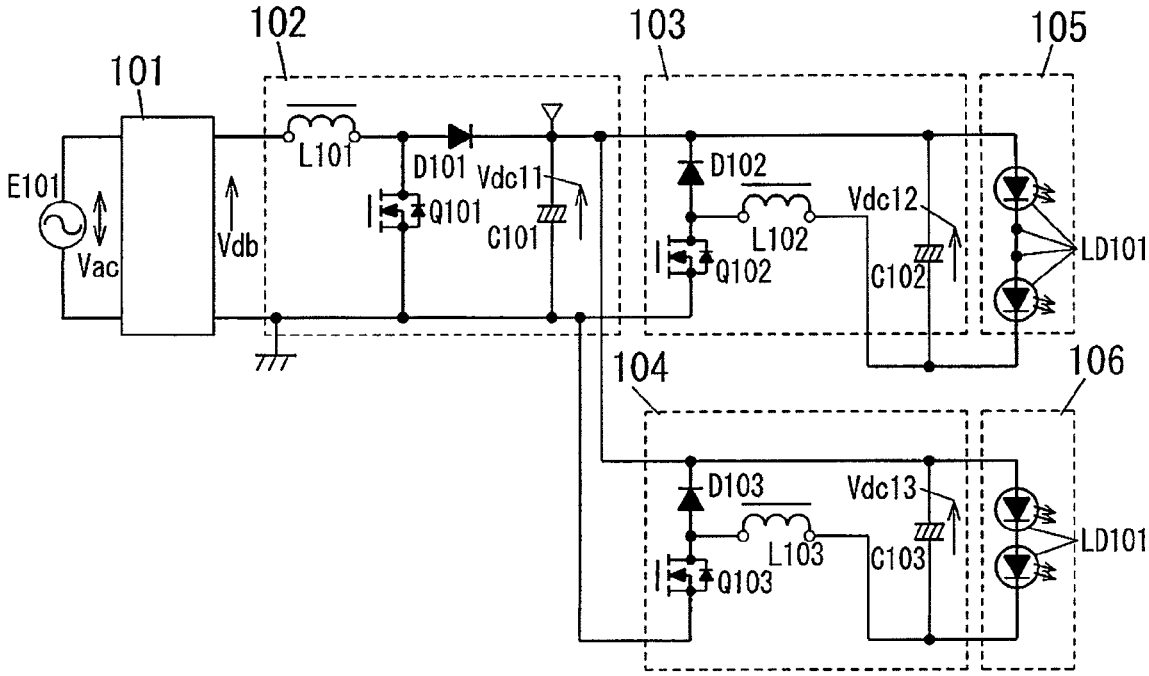
FIG. 4 is a circuit diagram of a conventional lighting device.

FIG. 3A shows waveform of an input current (an input current from the commercial power supply E1) in a case where the first light sources 5*a* and 5*b* are lit and the second light sources 6*a* and 6*b* are unlit. FIG. 3B shows waveform of the input current in a case where the second light sources 6*a* and 6*b* are lit and the first light sources 5*a* and 5*b* are unlit. FIG. 3C shows waveform of the input current in a case where the first light sources 5*a* and 5*b* and the second light sources 6*a* and 6*b* are lit.

The first lighting power supplies 3*a* and 3*b* for supplying lighting power to respective first light sources 5*a* and 5*b* employ the power-factor correction circuit 2 as their input power supply. Therefore, in the case where the first light sources 5*a* and 5*b* are lit and the second light sources 6*a* and 6*b* are unlit, the power factor is improved and the harmonic distortion is reduced (see FIG. 3A).

The second lighting power supplies 4*a* and 4*b* for supplying lighting power to respective second light sources 6*a* and 6*b* employ, as their input power supply, a capacitor input type rectifier circuit including a full-wave rectifier circuit 1 and a capacitor C4. Therefore, in the case where the second light sources 6*a* and 6*b* are lit and the first light sources 5*a* and 5*b* are unlit, an inrush current into the capacitor C4 occur at a time point t1, t11 after a specified time elapses from time point (t0, t10) of polarity inversion of an input current (having a cycle T1) as shown in FIG. 3B.

However, in the case where the first light sources 5*a* and 5*b* and the second light sources 6*a* and 6*b* are lit, waveform of the input current becomes synthesized waveform of input currents shown in FIGS. 3A and 3B, as shown in FIG. 3C. In the embodiment, total output power of the first lighting power supplies 3*a* and 3*b* (88 W+88 W=176 W) is set to be larger than total output power of the second lighting power supplies 4*a* and 4*b* (9 W+6 W=15 W). Therefore, a ratio of the inrush current to the input current becomes small. Harmonic distortion of the input current, in the case where the first light sources 5*a* and 5*b* and the second light sources 6*a* and 6*b* are lit, can satisfy Class C Standard established by IEC. Further, in a case where total output power of the first lighting power supplies 3*a* and 3*b* is larger than 25 W and total output power of the second lighting power supplies 4*a* and 4*b* is 15 W or less, harmonic distortion of the input current can satisfy Class C Standard established by IEC.

Although the present invention has been described with reference to certain preferred embodiments, numerous modifications and variations can be made by those skilled in the art without departing from the true spirit and scope of this invention, namely claims.

The invention claimed is:

1. A lighting device, comprising:
a rectifier circuit configured to rectify an AC voltage;
a power-factor correction circuit configured to receive the rectified voltage from the rectifier circuit to generate a first DC voltage;
a capacitor configured to reduce ripple of the rectified voltage to generate a second DC voltage;
one or more first lighting power supplies, of each of which input power supply is the first DC voltage, configured to supply lighting power to respective one or more first light sources each of which comprises one or more light emitting devices; and
one or more second lighting power supplies, of each of which input power supply is the second DC voltage, configured to supply lighting power to respective one or more second light sources each of which comprises one or more light emitting devices, wherein
an output voltage of the one or more second lighting power supplies is lower than an output voltage of the one or more first lighting power supplies.

2. The lighting device of claim 1, wherein each of the one or more first lighting power supplies comprises a step-down chopper circuit.

3. The lighting device of claim 1, wherein each of the one or more second lighting power supplies comprises a step-down chopper circuit.

4. The lighting device of claim 1, wherein
the one or more first lighting power supplies are two or more first lighting power supplies,
the one or more second lighting power supplies are two or more second lighting power supplies,
total output power of the two or more first lighting power supplies is larger than 25W, and
total output power of the two or more second lighting power supplies is 15W or less.

5. The lighting device of claim 1, wherein the second DC voltage is lower than the first DC voltage.

6. The lighting device of claim 1, wherein the power-factor correction circuit is configured to step up the rectified voltage to generate the first DC voltage so that the first DC voltage is higher than the second DC voltage.

7. The lighting device of claim 1, wherein the one or more first lighting power supplies are configured to step down the first DC voltage to generate respective output voltages of the one or more first lighting power supplies.

8. The lighting device of claim 1, wherein the one or more second lighting power supplies are configured to step down the second DC voltage to generate respective output voltages of the one or more second lighting power supplies.

9. The lighting device of claim 1, wherein the capacitor is connected in parallel with the power-factor correction circuit.

* * * * *